US005716747A

United States Patent [19]

Uneme et al.

[11] Patent Number: 5,716,747

[45] Date of Patent: Feb. 10, 1998

[54] FIXING DEVICE AND METHOD OF FIXING

[75] Inventors: Kazuhiko Uneme; Kazuo Yasuda, both of Hachioji, Japan

[73] Assignee: Konica Corporation, Tokyo, Japan

[21] Appl. No.: 524,611

[22] Filed: Sep. 7, 1995

[30] Foreign Application Priority Data

Sep. 29, 1994 [JP] Japan ..... 6-235280

[51] Int. Cl.[6] ..... G03G 13/20

[52] U.S. Cl. ..... 430/124; 399/67; 399/320; 399/340

[58] Field of Search ..... 430/124; 355/284; 399/67, 320, 340

[56] References Cited

FOREIGN PATENT DOCUMENTS

| | | |
|---|---|---|
| 0 018 140 | 10/1980 | European Pat. Off. . |
| 0 077 991 A3 | 5/1983 | European Pat. Off. . |
| 0 441 114 A1 | 8/1991 | European Pat. Off. . |
| 0 640 888 A1 | 3/1995 | European Pat. Off. . |
| 27 16 203 | 10/1977 | Germany . |
| 51-18544 | 2/1976 | Japan . |
| 52-124338 | 10/1977 | Japan . |
| 93/21567 | 10/1993 | WIPO . |

OTHER PUBLICATIONS

Patent Abstracts of Japan, vol. 12, No. 42 (1988) of JP-A-62 187372.

*Primary Examiner*—Mark Chapman

*Attorney, Agent, or Firm*—Frishauf, Holtz, Goodman, Langer & Chick, P.C.

[57] ABSTRACT

A fixing device includes a pair of fixing rollers to heat toner images and to fix the toner images on a recording medium in which at least one roller coming into contact with toner is provided thereon with fluorine containing resins and a device for coating fluorine containing silicone oil on the surface of the fluorine containing resins at a coating amount of not more than $1.4\times10^{-6}$ cc/cm$^2$.

4 Claims, 2 Drawing Sheets

FIXING DEVICE AND METHOD OF FIXING

BACKGROUND OF THE INVENTION

The present invention relates to a fixing device and a method of fixing, and more particularly, to an improvement of a fixing device and a method of fixing used in an image forming apparatus or the like.

As a method of fixing in a fixing device used in an image forming apparatus and others, there has been known a fixing device of a heat roller type wherein a heat roller is employed. In this method, resins serving as developing agents (toner) are fused and are caused to pass through a pair of rollers to be fixed on a recording medium such as a sheet of paper as toner images. Heretofore, silicone rubber has been used as a material for the surface of a fixing roller. However, releasability between a fixing roller and a recording medium is poor when the silicone robber is used as it is. Therefore, there has been employed a method wherein silicon oil composed of alkylpolysiloxane such as dimethylpolysiloxane is coated on the surface of a roller by an oil supply device.

However, an affinity of silicone oil composed of alkylpolysiloxane for the surface of a roller is low, and thereby a large amount of that oil is required for coating the oil on the roller surface uniformly. Therefore, there is used a technology wherein fluorine containing silicone oil having high affinity for the roller surface is coated on the surface of silicone rubber (Japanese Patent Publication Open to Public Inspection No. 18544/1976 (hereinafter referred to as Japanese Patent O.P.I Publication)). Further, in the combination of a roller employing silicone rubber and silicone oil composed of alkylpolysiloxane, the surface of a roller sometimes shows swellability for oil to be coated. To avoid that swellability is shown, there is used a technology to use a material which has an affinity for oil to be coated and does not swell (Japanese Patent O.P.I. Publication No. 124338/1977). Fluoroalkyl group-containing silicone oil that contains fluoropropyl group described in this official report shows formation of an oil film that is better than that of silicone oil composed simply of alkylpolysiloxane, but it is difficult to reduce a necessary amount of that silicone oil to be coated on a fixing roller.

On a full-color image forming apparatus, dimethyl silicone oil to be coated on the surface of silicone rubber requires a coating amount of not less than $8\times10^{-6}$ [cc/cm$^2$]. Durability of a rubber roller in terms of oil-swelling and abrasion is about tens of thousands of copies. An oil coating device requires some device such as an oil tank having a capacity for oil of hundreds cc.

As stated above, when silicone rubber is coated on the surface of a fixing roller, its durability is low. In addition, when silicone oil is used as oil to be coated, an affinity for the roller surface is low, and accordingly, a large amount of oil is needed for coating on the roller surface uniformly. As a result of a large amount of oil needed, a life of a device for supplying oil to be coated (for example, an oil pad or the like) is shortened. In some cases, an oil tank or an oil supply device which is expensive is needed.

SUMMARY OF THE INVENTION

The present invention has been achieved with the foregoing as a background, and its object is to provide a fixing device and a method of fixing wherein durability of a fixing roller is high and a life of a device for supplying oil to be coated can be lengthened by supplying oil having high surface wettability with the surface of a fixing roller.

In a first embodiment of the invention solving the problems stated above, there are provided a pair of fixing rollers heating toner images and fixing them on a recording medium wherein at least one roller coming into contact with toner is provided thereon with fluorine containing resins and a device for coating fluorine containing silicone oil on the surface of the aforesaid fluorine containing resins at a coating amount of not more than $1.4\times10^{-6}$ [cc/cm$^2$].

In a second embodiment of the invention solving the problems stated above, there is provided a pair of fixing rollers heating toner images and fixing them on a recording medium wherein at least one roller coming into contact with toner is provided thereon with fluorine containing resins, and fluorine containing silicone oil to be coated on the surface of the aforesaid fluorine containing resins has a structural unit represented by the following formula.

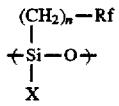

(1)

In the formula, X represents saturated hydrocarbon having 1–4 carbon atoms or an aryl group, Rf represents fluoroalkyl group having 2–10 carbon atoms, and n represents an integer ranging from 1 to 4. Rf represents preferably Z—$(CF_2)_m$—wherein Z represents hydrogen or a fluorine atom, and m represents an integer ranging from 2 to 10.

In these first and second embodiments, it is preferable from the viewpoint of heat resistance, high durability and releasability from toner that fluorine containing resin that forms the aforesaid fluorine containing resin layer is any of PTFE, PFA and FEP.

In a third embodiment of the invention solving the problems stated above, there is provided a pair of fixing rollers heating toner images and fixing them on a recording medium wherein at least one roller coming into contact with toner is provided thereon with fluorine containing resins, and fluorine containing silicone oil is coated on the surface of the aforesaid fluorine containing resins at a coating amount of not more than $1.4\times10^{-6}$ [cc/cm$^2$].

In a fourth embodiment of the invention solving the problems stated above, there is provided a pair of fixing rollers heating toner images and fixing them on a recording medium wherein at least one roller coming into contact with toner is provided thereon with fluorine containing resins, and fluorine containing silicone oil having a structural unit represented by the following formula is coated on the surface of the aforesaid fluorine containing resins.

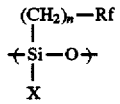

In the formula, X represents saturated hydrocarbon having 1–4 carbon atoms or an aryl group, Rf represents fluoroalkyl group having 2–10 carbon atoms, and n represents an integer ranging from 1 to 4. Rf represents preferably Z—$(CF_2)_m$—wherein Z represents hydrogen or a fluorine atom, and m represents an integer ranging from 2 to 10.

In these third and fourth embodiments, it is preferable from the viewpoint of heat resistance, high durability and releasability from toner that fluorine containing resin that forms the aforesaid fluorine containing resin layer is any of PTFE, PFA and FEP.

There are provided a pair of fixing rollers heating toner images and fixing them on a recording medium wherein at least one roller coming into contact with toner is provided thereon with fluorine containing resins and a device for coating fluorine containing silicone oil on the surface of the aforesaid fluorine containing resins at a coating amount of not more than $1.4\times10^{-6}$ [cc/cm$^2$]. Owing to this, durability of a fixing roller is high, and a life of a device for supplying oil to be coated can be lengthened by supplying oil having high surface wettability with the surface of a fixing roller.

There is provided a pair of fixing rollers heating toner images and fixing them on a recording medium wherein at least one roller coming into contact with toner is provided thereon with fluorine containing resins, and fluorine containing silicone oil to be coated on the surface of the aforesaid fluorine containing resins has a structural unit represented by the following formula.

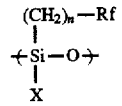

In the formula, X represents saturated hydrocarbon having 1–4 carbon atoms or an aryl group, Rf represents fluoroalkyl group having 2–10 carbon atoms, and n represents an integer ranging from 1 to 4. Owing to this, durability of a fixing roller is high, and a life of a device for supplying oil to be coated can be lengthened by supplying oil having high surface wettability with the surface of a fixing roller.

In the case mentioned above, it is possible to improve heat resistance, high durability and releasability from toner by using any of PTFE, PFA and FEP as fluorine containing resin that forms the aforesaid fluorine containing resin layer.

By providing a pair of fixing rollers heating toner images and fixing them on a recording medium wherein at least one roller coming into contact with toner is provided thereon with fluorine containing resins, and by coating fluorine containing silicone oil on the surface of the aforesaid fluorine containing resins at a coating amount of not more than $1.4\times10^{-6}$ [cc/cm$^2$], it is possible to keep the fixing rollers to be durable and it is possible to supply coating oil having high surface wettability with the surface of a fixing roller and thereby to extend the life of a coating oil supply system.

By providing a pair of fixing rollers heating toner images and fixing them on a recording medium wherein at least one roller coming into contact with toner is provided thereon with fluorine containing resins, and by coating fluorine containing silicone oil having a structural unit represented by the following formula on the surface of the aforesaid fluorine containing resins, it is possible to keep the fixing rollers to be durable and it is possible to supply coating oil having high surface wettability with the surface of a fixing roller and thereby to extend the life of a coating oil supply system.

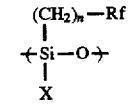

In the formula described above, Z represents a hydrocarbon group having 1–4 carbon atoms or an aryl group, Rf represents an fluoroalkyl group having 2–10 carbon atoms, and n is an integer of 1–4.

In these cases, it is possible to improve heat resistance, high durability and releasability from toner by using any one of PTFE, PFA and FEP as fluorine containing resin that forms the layer of fluorine containing resins. In the invention wherein alkyl-fluoride-substituted silicone oil is used, the number of fluorine is related to a great effect for uniform adhesion of oil to a fixing roller that is covered with fluorocarbon resins. In this case, it is preferable that the number of carbon atoms of alkyl fluoride is 2–10 and a part which is directly linked to a silicon atom is a methylene chain. A range of 2–8 for the number of carbon atoms is more appropriate. When the number of carbon atoms of this alkyl fluoride is excessive, a problem occurs on fluidity that is under the heated condition. When the number of carbon atoms of alkyl fluoride is too less, on the other hand, wettability with the surface of a heat roller covered with fluorocarbon resins can not be improved and thereby a uniform oil film can not be formed.

Further, as a terminal group, it is preferable that it is a carbon fluoride group linked to a saturated hydrocarbon group or a methylene group such as a methyl group or a ethyl group.

Though silicone oil used in the invention needs to have the aforementioned repeating unit, it may also be of a construction as a copolymer with dimethyl silicon, phenylmethyl silicon or diphenyl silicon. In the case of this construction as a copolymer, 20 mole % or more of a construction of fluorine containing silicone oil of the invention needs to be included. When an amount is less than 20 mole %, fluorine containing silicone oil does not show its effect, but effects of other construction are exhibited remarkably. Fluorine containing silicone oil of the invention needs to be liquid substance having appropriate viscosity when it is used. For this reason, a coefficient of viscosity of fluorine containing silicone oil of the invention at 25° C. is 20–1000 cs, and its appropriate range is 100–500 cs. This viscosity represents dynamic viscosity and it can be measured practically by an Ubbelohde viscometer. This viscosity can be controlled by adjusting a degree of polymerization of fluorine containing silicone oil of the invention.

DETAILED DESCRIPTION OF THE PREFERRED EMBODIMENT

The invention will be explained in detail as follows, referring to drawings.

Figure 1:
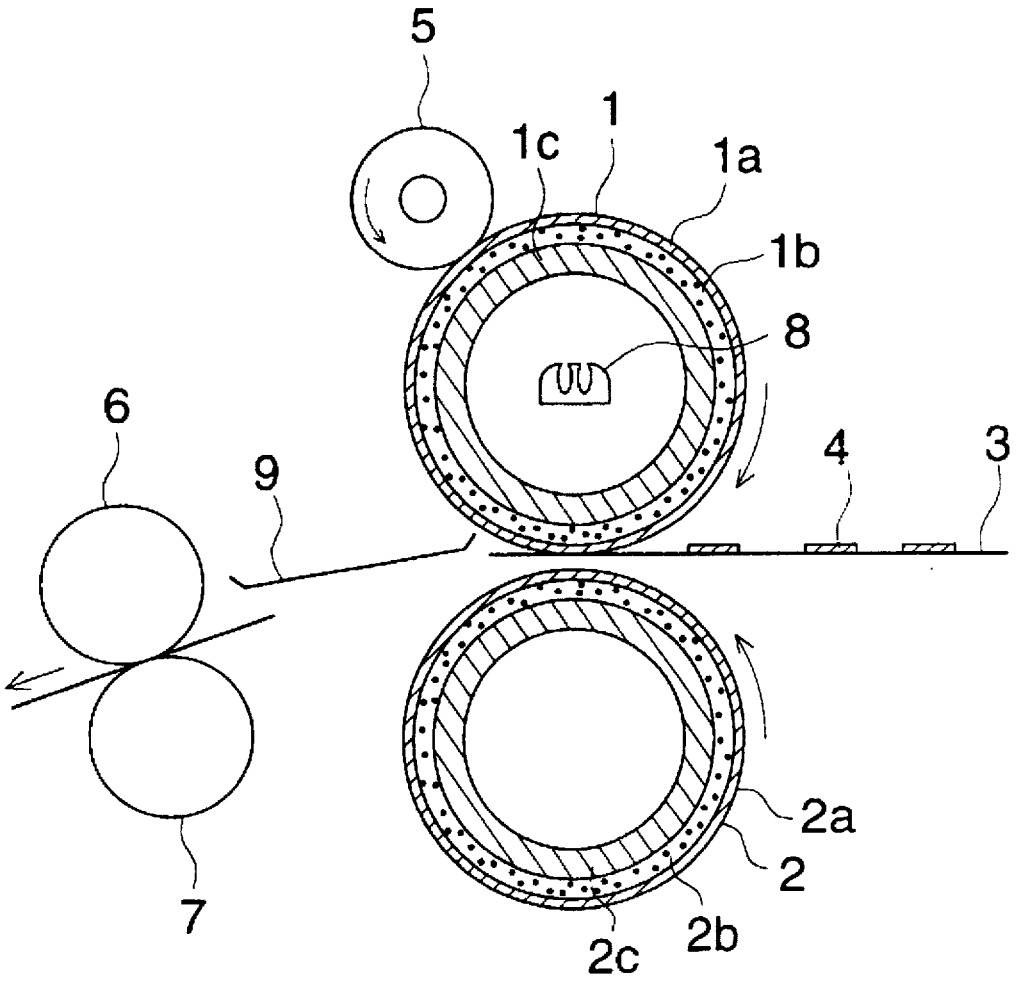
FIG. 1 is a diagram showing an example of a principle and constitution of the invention.

FIG. 1 is a diagram showing an example of a principle and constitution of the invention. In the figure, 1 represents an upper fixing roller, and 2 represents a lower fixing roller that form a counterpart to the upper fixing roller. In the upper fixing roller 1, the numeral 1*a* is a fluorocarbon resin layer forming a superficial layer of the upper fixing roller 1, the numeral 1*b* is an elastic layer positioned under the fluorocarbon resin layer 1*a*, and 1*c* is a core metal that is provided inside the elastic layer 1*b* and serves as a core of the roller. As the fluorocarbon resin layer 1*a*, PFA (ethylenetetrafluorite-perfluoroalkoxyethylene copolymer), for example, is used. PFA resin has a principal chain of polyfluoroethylene and,—OR group (R is perfluoroalkyl group) is linked to a side chain. As a material of fluorocarbon resin, PTFE (polytetrafluoroethylene), FEP (polyfluoroethylenepropylene copolymer) and others are used in addition to the foregoing. These PFA, PTFE and FEP have characteristics that durability is extremely high compared with fluorocarbon resins of other kinds.

As a thickness of the fluorocarbon resin layer 1*a*, a thickness of about 50 μm, for example, is used. As the elastic layer 1*b*, silicone rubber, for example, is used, and its thickness used is 1 mm, for example, and its hardness used is about JIS-A 13°. As the core metal 1*c*, aluminum, for example, is used and as a thickness of the core metal used is about 3 mm, for example. The numeral 8 is a heating means provided inside the upper heating roller 1. As the heating means 8, a halogen lamp heater, for example, is used and its output used is about 850 W, for example, so that the surface of the fixing roller may be heated up to about 200° C.

The lower fixing roller 2 is the same as the upper fixing roller 1 in terms of constitution. Namely, in the lower fixing roller 2, the numeral 2*a* is a fluorocarbon resin layer forming a superficial layer of the lower fixing roller 2, the numeral 2*b* is an elastic layer positioned under the fluorocarbon resin layer 2*a*, and 2*c* is a core metal that is provided inside the elastic layer 2*b* and serves as a core of the roller. As the fluorocarbon resin layer 2*a*, PFA, for example, is used, and its thickness used is about 50 μm. As the elastic layer 2*b*, silicone rubber, for example, is used, and its thickness used is 1 mm, for example, and its hardness used is about JIS-A 13°. As the core metal 2*c*, steel, for example, is used and its thickness used is about 3 mm, for example. When the thickness of the elastic layers 1*b* and 2*b* mentioned above is 0.5–5.0 mm, toner images can be fixed uniformly on recording medium 3, which is convenient, because uniform fixing of toner images is necessary for full color fixing that is required for high image quality.

The rollers 1 and 2 mentioned above rotate respectively in the direction shown in the figure. Incidentally, the fluorocarbon resin layer forming the superficial layer on each of the fixing rollers 1 and 2 has only to be provided at least on the roller (upper fixing roller 1) coming into contact with toner images, and the lower fixing roller 2 does not necessarily need to be provided with the fluorocarbon resin layer.

The numeral 3 is a recording medium such as a recording sheet and a transparency sheet, and 4 is a toner image formed on recording medium 3. The numeral 5 is an oil coating roller as a system (means) to coat fluorine containing silicone oil on the surface of upper fixing roller 1. This oil coating means does not need to be of a form of a roller as the coating roller 5 is, but it may take any form provided that it has a system to coat oil on the surface of upper fixing roller 1 uniformly. The numerals 6 and 7 represent a sheet-ejecting roller that ejects recording medium 3 on which an image has been fixed. The numeral 9 is a guide that leads the recording medium 3 ejected from the fixing rollers 1 and 2 to the sheet-ejecting rollers 6 and 7. Movements of an apparatus constituted as in the foregoing will be explained as follows.

A toner image obtained by a developing unit through development of an electrostatic latent image formed on a photoreceptor is transferred onto recording medium 3 which is conveyed to a fixing unit by a conveyance system. This toner image 4 may be either a monochromatic toner image or a color toner image. In the fixing unit, upper fixing roller 1, lower fixing roller 2 and oil coating roller 5 are rotated in the directions shown in the figure.

When recording medium 3 passes through fixing rollers 1 and 2 while being sandwiched between the fixing rollers 1 and 2, toner image 4 thereon is subjected to heat-fusion at around 200° C. and then is fixed on the recording medium 3. Under such condition, durability of each of the fixing rollers is higher than that of a roller made of material of silicone rubber because a superficial layer of the fixing roller is made of a fluorocarbon resin layer. In this case, the use of the aforementioned PFA, PTFE or FEP as a fluorocarbon resin layer makes the durability to be extremely high. The recording medium 3 on which images have been fixed is conveyed to the sheet-ejecting rollers 6 and 7 through guide 9 to be ejected.

In such fixing operation as stated above conducted by the fixing rollers 1 and 2, fluorine containing silicone oil is constantly supplied to the upper fixing roller 1 from oil coating roller 5. This fluorine containing oil has high affinity with fluorocarbon resin layer 1*a* and thereby is coated uniformly and entirely on the surface of the upper fixing roller 1. Therefore, releasability for the recording medium 3 to be released from the fixing rollers 1 and 2 is greatly improved.

Figure 2:
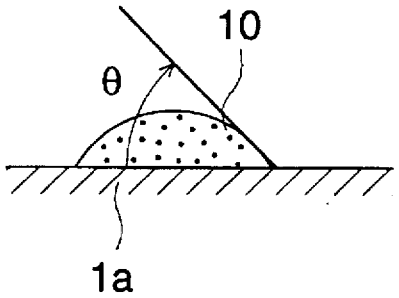
FIG. 2(*a*) and 2(*b*) are illustrations which show a comparison of affinity between dimethyl silicone oil and fluorine containing silicone oil.
Figure 2:
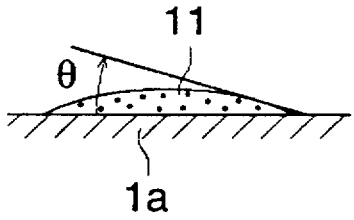

FIGS. 2(*a*) and 2(*b*) show an illustration of comparison of affinity between dimethyl silicone oil and fluorine containing silicone oil. FIG. 2(*a*) shows how dimethyl silicone oil sticks to the surface of a fluorocarbon resin layer, while FIG. 2(*b*) shows how fluorine containing silicone oil sticks to the surface of a fluorocarbon resin layer. In the case of dimethyl silicone oil shown in FIG. 2(*a*), contact angle θ formed between dimethyl silicone oil 10 and a fluorocarbon resin layer 1*a* is about 30°–40°, while contact angle θ formed between fluorine containing silicone oil 11 and a fluorocarbon resin layer 1*a* is 10° or less. A small contact angle means that affinity is high (surface tension is small) and oil tends to spread over the fluorocarbon resin layer 1*a*. This further means that wettability of fluorine containing silicone oil is higher and thereby broader area can be coated with the same amount of oil. Accordingly, less amount of oil to be coated is required for fluorine containing silicone oil, resulting in longer life of a coating oil supply system. The surface tension at 20 dyn/cm of this fluorine containing silicone oil is a preferable condition for it to have high affinity. A coating amount of $1.4\times10^6$ [cc/cm$^2$] or less for fluorine containing silicone oil is a preferable condition for supplying coating oil on the surface of a fixing roller uniformly and entirely, for lessening an influence of excessive oil on an image, and for lengthening life of a coating oil supply system. In the invention, as stated above, it is possible to realize a fixing device wherein durability of a fixing roller is high and life of a coating oil supply system is long, by using a fluorocarbon resin layer for a superficial layer of a fixing roller and using fluorine containing silicone oil as coating oil.

Chemicals 7 and 8 shown below represent concrete structural examples of fluorine containing silicone oil shown in Formula (1). Thirteen kinds of structures of fluorine containing silicone oil ranging from (1) to (13) are shown. In this case, a and b represent an integer of not less than one, and a and b preferably represent an integer of 10–2000, and more preferable range thereof is 100–1000.

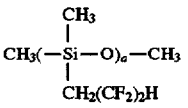

(1)

Viscosity = 450 cs

-continued (2)

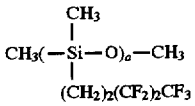

Viscosity = 250 cs (3)

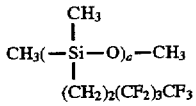

Viscosity = 300 cs (4)

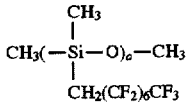

Viscosity = 500 cs (5)

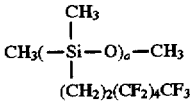

Viscosity = 350 cs (6)

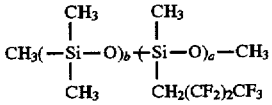

Viscosity = 320 cs, a:b = 80:20

(7)

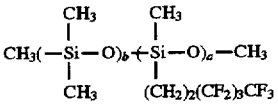

Viscosity = 300 cs, a:b = 60:40

(8)

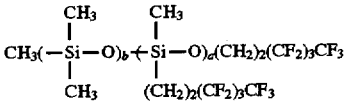

Viscosity = 300 cs, a:b = 70:30

(9)

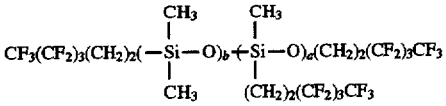

Viscosity = 300 cs, a:b = 80:20

(10)

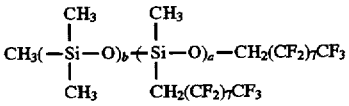

Viscosity = 450 cs, a:b = 50:50

(11)

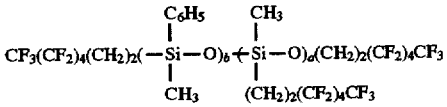

Viscosity = 200 cs, a:b = 30:70

-continued (12)

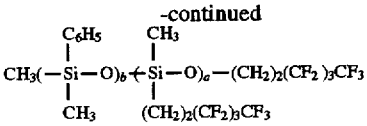

Viscosity = 500 cs, a:b = 90:10

(13)

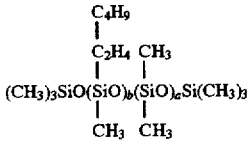

Viscosity = 300 cs, a:b = 80:20

Effects of the invention will be explained as follows, referring to experimental examples. Table 1 shows examples of conditions for the experiments made by the use of a fixing device shown in FIG. 1.

In addition, it is also possible to use substances represented by the structural formula for compounds shown below.

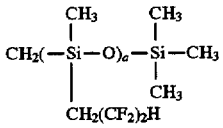

TABLE 1

| Experiment No. | Fluorocarbon resin layer | Coating amount (cc/cm$^2$) | Silicone oil |
|---|---|---|---|
| Experimental example 1 | PFA | $1.3 \times 10^{-6}$ | (3) |
| Experimental example 2 | PTFE | $1.0 \times 10^{-6}$ | (3) |
| Experimental example 3 | PFA | $8.3 \times 10^{-7}$ | (7) |
| Experimental example 4 | PTFE | $4.3 \times 10^{-7}$ | (3) |
| Experimental example 5 | PFA | $1.3 \times 10^{-7}$ | (8) |
| Experimental example 6 | FEP | $0.5 \times 10^{-6}$ | (13) |
| Experimental example 7 | PFA | $1.5 \times 10^{-6}$ | (13) |
| Experimental example 8 | PFA | $1.0 \times 10^{-6}$ | (14) |
| Experimental example 9 | PFA | $1.0 \times 10^{-6}$ | (15) |
| Experimental example 10 | PFA | $2.0 \times 10^{-6}$ | (3) |
| Experimental example 11 | PFA | None | None |
| Experimental example 12 | PFA | $1.0 \times 10^{-6}$ | Dimethylpoly siloxane |
| Experimental example 13 | PFA | $2.0 \times 10^{-6}$ | Dimethylpoly siloxane |

The number of experimental devices in total was thirteen including those for experimental examples 1 through 13. A fluorocarbon resin layer, a coating amount of oil and silicone oil (parenthesized numbers in the table correspond to those in Chemicals 1 and 2) all shown in the table were used for each experimental example. Silicone oil (14) in this case is fluorine silicone oil having on its side chain a trifluoropropyl group which is sold from Dow Corning Co., Ltd. in a trade name of FS-1265. Fluorine silicone oil (15) has the following structure.

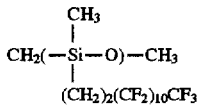

(15)

Viscosity = 450 cs

Incidentally, lower fixing roller 2 (see FIG. 1) of the fixing device used was one structured with a silicone rubber roller.

For evaluation, a copying machine U-Bix 3035 manufactured by Konica Corp. was modified so that the fixing device mentioned above was used therein. In the evaluation, printing of 500,000 sheets was conducted under the ambient conditions of high temperature and high humidity (33° C./80% RH) in the state of heating up to 195° C, and deformation of the upper fixing roller 1 and lower fixing roller 2 was observed. The results thereof are shown in Table 2.

TABLE 2

| Experiment No. | State of upper roller | State of lower roller |
|---|---|---|
| Experimental example 1 | No change | No change |
| Experimental example 2 | No change | No change |
| Experimental example 3 | No change | No change |
| Experimental example 4 | No change | No change |
| Experimental example 5 | No change | No change |
| Experimental example 6 | No change | No change |
| Experimental example 7 | No change | No change |
| Experimental example 8 | Occurrence of slight scratch on roller | Occurrence of slight scratch on roller |
| Experimental example 9 | Occurrence of slight scratch on roller | Occurrence of slight scratch on roller |
| Experimental example 10 | Occurrence of slight scratch on roller | Occurrence of slight scratch on roller |
| Experimental example 11 | No change | No change |
| Experimental example 12 | Occurrence of scratch on roller | Occurrence of scratch on roller |
| Experimental example 13 | Occurrence of scratch on roller | Occurrence of scratch on roller |

Table 2 shows that no change was observed on both upper roller and lower roller for Experimental examples 1–7, while for Experimental examples 8–10, both upper roller and lower roller showed slight scratches which, however, were not problematic in practical use. For Experimental example 11, no change was observed on both upper and lower rollers. For Experimental examples 12–13, both upper roller and lower roller showed scratches thereon.

On the other hand, the presence of an offset problem which is an offset printing phenomenon on the fixing roller was examined by printing an image of 5% pixel and observing the state of soil, which resulted in the contents shown in Table 3.

TABLE 3

| Experiment No. | Occurrence of offset problem |
|---|---|
| Experimental example 1 | No occurrence |
| Experimental example 2 | No occurrence |

TABLE 3-continued

| Experiment No. | Occurrence of offset problem |
|---|---|
| Experimental example 3 | No occurrence |
| Experimental example 4 | No occurrence |
| Experimental example 5 | No occurrence |
| Experimental example 6 | No occurrence |
| Experimental example 7 | No occurrence |
| Experimental example 8 | Occurred |
| Experimental example 9 | Occurred |
| Fxperimental example 10 | Occurred |
| Experimental example 11 | Occurred excessively |
| Experimental example 12 | Occurred |
| Experimental example 13 | Occurred |

Table 3 above shows that no offset problem was observed for Experimental examples 1–7, and an occurrence of the offset problem was observed for Experimental examples 8–10. For Experimental example 11, an offset problem occurred excessively, while for Experimental examples 12 and 13, an occurrence of the offset problem was observed.

From the experimental results mentioned above, it was found that durability of fixing rollers is high and offset problems hardly occur in the fixing device wherein fluorine containing resins are used for the superficial layer of a roller coming into contact with toner and fluorine containing silicone oil is used as coating oil.

As stated in detail above, in the invention, there are provided a pair of fixing rollers heating toner images and fixing them on a recording medium wherein at least one roller coming into contact with toner is provided thereon with fluorine containing resins and a device for coating fluorine containing silicone oil on the surface of the aforesaid fluorine containing resins at a coating amount of not more than $1.4\times10^{-6}$ [cc/cm$^2$]. Owing to this, it is possible to keep the fixing rollers to be durable and it is possible to supply coating oil having high surface wettability with the surface of a fixing roller and thereby to extend the life of a coating oil supply system.

By providing a pair of fixing rollers heating toner images and fixing them on a recording medium wherein at least one roller coming into contact with toner is provided thereon with fluorine containing resins, and by coating fluorine containing silicone oil having a structural unit represented by the following formula on the surface of the aforesaid fluorine containing resins, it is possible to keep the fixing rollers to be durable and it is possible to supply coating oil having high surface wettability with the surface of a fixing roller and thereby to extend the life of a coating oil supply system.

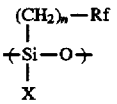

In the formula described above, Z represents a hydrocarbon group having 1–4 carbon atoms or an aryl group, Rf represents an fluoroalkyl group having 2–10 carbon atoms, and n is an integer of 1–4.

In these cases, it is possible to improve heat resistance, high durability and releasability from toner by using any one of PTFE, PFA and FEP as fluorine containing resin that forms the layer of fluorine containing resins.

By providing a pair of fixing rollers heating toner images and fixing them on a recording medium wherein at least one roller coming into contact with toner is provided thereon with fluorine containing resins, and by coating fluorine containing silicone oil on the surface of the aforesaid fluorine containing resins at a coating amount of not more than $1.4\times10^{-6}$ [cc/cm$^2$], it is possible to keep the fixing rollers to be durable and it is possible to supply coating oil having high surface wettability with the surface of a fixing roller and thereby to extend the life of a coating oil supply system.

By providing a pair of fixing rollers heating toner images and fixing them on a recording medium wherein at least one roller coming into contact with toner is provided thereon with fluorine containing resins, and by coating fluorine containing silicone oil having a structural unit represented by the following formula on the surface of the aforesaid fluorine containing resins, it is possible to keep the fixing rollers to be durable and it is possible to supply coating oil having high surface wettability with the surface of a fixing roller and thereby to extend the life of a coating oil supply system.

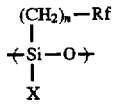

In the formula described above, Z represents a hydrocarbon group having 1–4 carbon atoms or an aryl group, Rf represents an fluoroalkyl group having 2–10 carbon atoms, and n is an integer of 1–4.

In these cases, it is possible to improve heat resistance, high durability and releasability from toner by using any one of PTFE, PFA and FEP as fluorine containing resin that forms the layer of fluorine containing resins.

In the present invention, as stated above, a fluorine containing resin layer is used as a superficial layer of a fixing roller, and fluorine containing silicone oil is used as coating oil, and thereby it is possible to realize a fixing device and a method of fixing wherein durability of fixing rollers is high and life of a coating oil supply system can be extended, which results in an extremely great effect in practical use.

What is claimed is:

1. A fixing device comprising:

(a) a pair of fixing rollers for heating and pressing a toner image and for fixing the toner image on a recording medium, at least an outermost layer of one roller which comes into contact with the toner image being provided with fluorine containing resin; and (b) a coating device for coating fluorine containing silicone oil on the outermost layer of the one roller, wherein the fluorine containing silicone oil to be coated has a structural unit represented by the following formula:

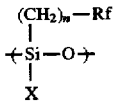

where X represents saturated hydrocarbon having 1 to 4 carbon atoms or an aryl group, Rf represents fluoroalkyl group having 2 to 10 carbon atoms, and n represents an integer of 1 to 4.

2. The fixing device of claim 1, wherein a coating amount of the fluorine containing silicone oil is not more than $1.4\times10^{-6}$ cc/cm$^2$.

3. The fixing device of claim 2, wherein Rf represents $$Z-(CF_2)_m-$$

where z represents hydrogen or a fluorine atom, and m represents an integer of 2 to 10.

4. The fixing device of claim 1, wherein the fluorine containing resin that forms the outermost layer of the one roller, is one of ethylenetetrafluorideperfluoroalkoxyethylene copolymer, polytetrafluoroethylene and polyfluoroethyleneproplylene copolymer.

* * * * *